US008303167B2

(12) United States Patent
Dehon

(10) Patent No.: US 8,303,167 B2
(45) Date of Patent: Nov. 6, 2012

(54) ESCAPEMENT MECHANISM

(75) Inventor: Nicolas Dehon, La Chaux-de-Fonds (CH)

(73) Assignee: Sowind SA, La Chaux-de-Fonds (CH)

( * ) Notice: Subject to any disclaimer, the term of this patent is extended or adjusted under 35 U.S.C. 154(b) by 188 days.

(21) Appl. No.: 12/934,204

(22) PCT Filed: Mar. 24, 2009

(86) PCT No.: PCT/EP2009/053439

§ 371 (c)(1),
(2), (4) Date: Sep. 23, 2010

(87) PCT Pub. No.: WO2009/118310

PCT Pub. Date: Oct. 1, 2009

(65) Prior Publication Data

US 2011/0019506 A1 Jan. 27, 2011

(30) Foreign Application Priority Data

Mar. 27, 2008 (EP) ..... 08153450

(51) Int. Cl.
*G04B 15/00* (2006.01)

(52) U.S. Cl. ..... 368/127; 368/129

(58) Field of Classification Search ..... 368/124, 368/125, 127–130, 169–170
See application file for complete search history.

(56) References Cited

U.S. PATENT DOCUMENTS 2,340,677 A * 2/1944 Marti ..... 368/176
2,501,266 A * 3/1950 Ensign et al. ..... 368/131
7,963,693 B2 * 6/2011 Genequand ..... 368/170
2007/0103184 A1 * 5/2007 Kim ..... 324/769

FOREIGN PATENT DOCUMENTS

WO 99064936 A 12/1999

OTHER PUBLICATIONS

European Search Report, dated Nov. 10, 2008, from corresponding PCT application.
International Search Report, dated Jul. 14, 2009, from corresponding PCT application.

* cited by examiner

*Primary Examiner* — Vit W Miska
(74) *Attorney, Agent, or Firm* — Young & Thompson

(57) ABSTRACT

An escapement mechanism adapted for transmitting mechanical energy pulses from a driving source to an oscillating regulator of a timepiece via a blade spring (12) operating in a buckling manner about a curvature point, wherein the blade spring (12) can build up the energy from the driving source between two pulses and transmit the same to the oscillating regulator upon each pulse via first (18) and second (26) levers. In order to optimize the adjustment of the tension of the blade spring (12), the latter is mounted on a frame (50) capable of symmetric deformation relative to a first axis (AA) extending through the rotation axes of the regulator, the levers (18, 26) and through the curvature point, and relative to a second axis (BB) perpendicular to the first one and extending through the ends of the blade spring (12).

19 Claims, 5 Drawing Sheets

ESCAPEMENT MECHANISM

TECHNICAL FIELD

The present invention concerns the field of mechanical horology. It more particularly concerns an escapement mechanism arranged to transmit mechanical energy pulses from a driving source to an oscillating regulator of a timepiece via a blade spring operating in a buckling manner about a curvature point. The blade spring is capable of accumulating the energy from the driving source between two pulses and transmitting it to said oscillating regulator upon each pulse via first and second yokes.

BACKGROUND OF THE INVENTION

A mechanism of this type is known from document WO 99/64936, which more generally discloses a method for transmitting mechanical energy pulses from a driving source to an oscillating regulator via a blade spring operating in a buckling manner. More particularly, this method is implemented in particular using an escapement mechanism illustrated in FIG. 1, designed to maintain the oscillations of a regulator, of the sprung balance 10 type, for example, by delivering energy to it received from a driving source, such as a barrel for example, not shown in the drawing, via a blade spring 12, the ends of which are positioned such that it occupies a stable position corresponding to a second mode buckling.

The mechanism includes a plate 14 provided with an impulse-pin 16, mounted on the balance 10. The mechanism also includes a first detent yoke 18, ending with a fork 20 of a traditional type, provided with an inlet horn 20*a* and an outlet horn 20*b* and a dart 20*c*, designed to cooperate with the pin 16 and the plate 14, respectively. The lever ends with a tail 22 and also supports first 24 and second 25 protruding active elements, situated in the plane of the blade spring 12.

The mechanism also includes a second winding yoke 26, comprising a central portion and two symmetrical wings, each supporting, at their end, a key-pin assembly 28 and 29, designed to cooperate with the blade spring 12. The central portion also receives third 30 and fourth 31 active elements, designed to cooperate with first 32 and second 34 escapement wheels.

The two yokes 18 and 26 are mounted free in rotation in reference to each other. However, banking and guide means, which will not be described in detail, connect them, but with play, such that a movement of one yoke causes the movement of the other, but with a certain staggering.

The first 32 and second 34 escapement wheels are arranged on either side and symmetrically in relation to a line passing through the axes of rotation of the balance 10, the yokes 18 and 26 and via the curvature point of the blade spring 12. The wheels 32 and 34 each include a pinion 36 and 38 and mesh with the last wheel 40 of the going train. The wheels 32 and 34 include a particular toothing, the shape of which is adapted to cooperate with the first and second active elements of the second yoke, on one hand to transmit energy to that yoke and, on the other hand, to block the rotation of the wheels, according to operating phases that will be summarized below. For more details, see the document cited in the introduction.

During the main part of an operating cycle, the escapement wheels 32 and 34 can pivot and are not blocked through contact with the third 30 and fourth 31 active elements of the second yoke 26. Thus, in a winding phase, when the balance 10 performs its additional arc, the first escapement wheel 32 turns freely and the second escapement wheel 34 cooperates with the fourth active element 31 of the second yoke 26 to cause it to pivot. The keys-pins 28 and 29 then exert two opposing forces on the blade spring 12, identical and symmetrical in relation to its curvature point. The blade spring 12 then leaves its initial stable state corresponding to a second mode buckling and deforms while winding, without, however, acting on the first yoke 18 at its active elements 24, 25. At this stage, the relative rotational play between the yokes 18 and 26 allows the first yoke 18 to remain immobile.

The balance 10 freely continuing its rotation, the escapement wheels 32 and 34 also continue their movement, until the second wheel 34 locks on the fourth active element 31. The second yoke 26 has continued its pivoting, and the keys-pins 28 and 29 have acted on the blade spring 12, which has continued its winding to a metastable state close to an unstable state corresponding to a fourth mode buckling. The blade spring 12 is then maximally wound. By cooperating with the tail of the first yoke 18, the fourth active element 31 positions the first 24 and second 25 active elements.

During the following step, the balance 10 continuing its oscillation, the pin 16 strikes the inlet horn 20*a* of the fork 20. The first yoke 18 then acts on the blade spring 12 via the first active element 24. The blade spring 12 then suddenly tilts from its unstable position to a stable state corresponding to a second mode buckling opposite the previous one. This change of state allows the blade spring 12 to act on the keys-pins 28 and 29, which causes the second yoke 26 to pivot, driving the unlocking of the second escapement wheel 34. The second yoke 26 pivots until the third active element 30 encounters one of the teeth of the first escapement wheel 32. During the change of state of the blade spring 12, this also acts on the second active element 25 of the first yoke 18, thereby communicating to the balance 10 the energy accumulated during the winding of the blade spring 12, via the outlet horn 20*b*.

During the following alternation, the phases described above are reproduced symmetrically in relation to the plane passing through the axes of rotation of the balance 10, first 18 and second 26 yokes and through the curvature point of the blade spring 12.

Such an escapement mechanism is particularly interesting, in particular for the advantages mentioned in the aforementioned document. More particularly, it makes it possible to obtain an interesting efficiency, by decreasing the stop times of the different elements and the inertias to overcome during operation.

However, it has been observed that adjusting the tension of the blade spring 12 and its position was particularly important to obtain correct operation of the mechanism. In the mechanism disclosed in the aforementioned document, the blade spring 12 is mounted in compression between two settings or using pivot organs. However, adjusting the tension is very delicate with a configuration as proposed in the prior art.

The present invention aims in particular to resolve this problem. It also proposes a particularly advantageous embodiment in its implementation.

BRIEF DESCRIPTION OF THE INVENTION

This aim is achieved owing to an escapement mechanism whereof the features are detailed in the claims.

The invention also concerns a part implemented in the assembly of the mechanism and a method for that assembly.

BRIEF DESCRIPTION OF THE DRAWINGS

Other features of the present invention will appear more clearly upon reading the description that follows, done in reference to the appended drawings, in which, aside from FIG. 1 described above in reference to the state of the art.

DETAILED DESCRIPTION OF THE INVENTION

Figure 1:
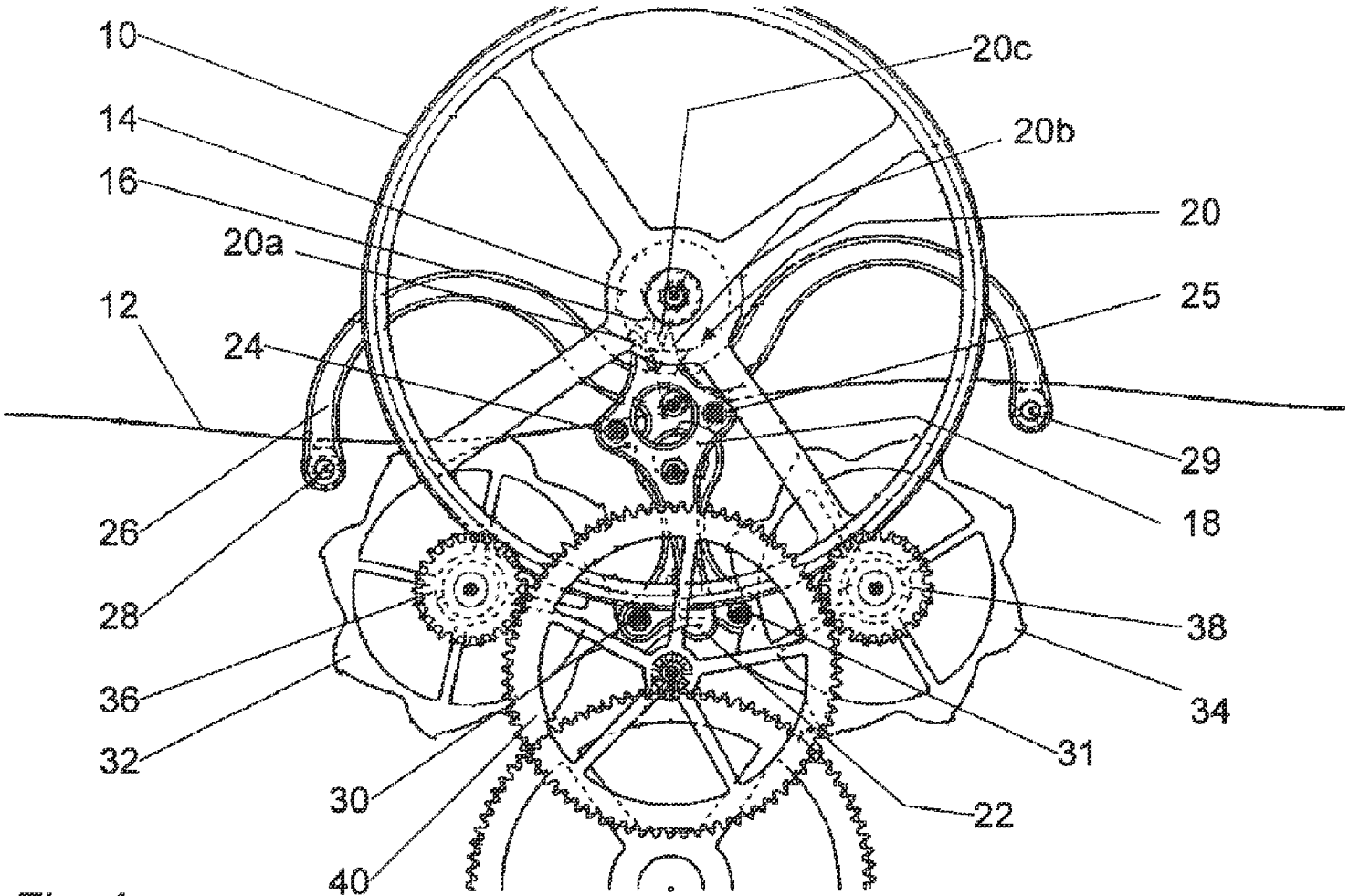
Figure 2:
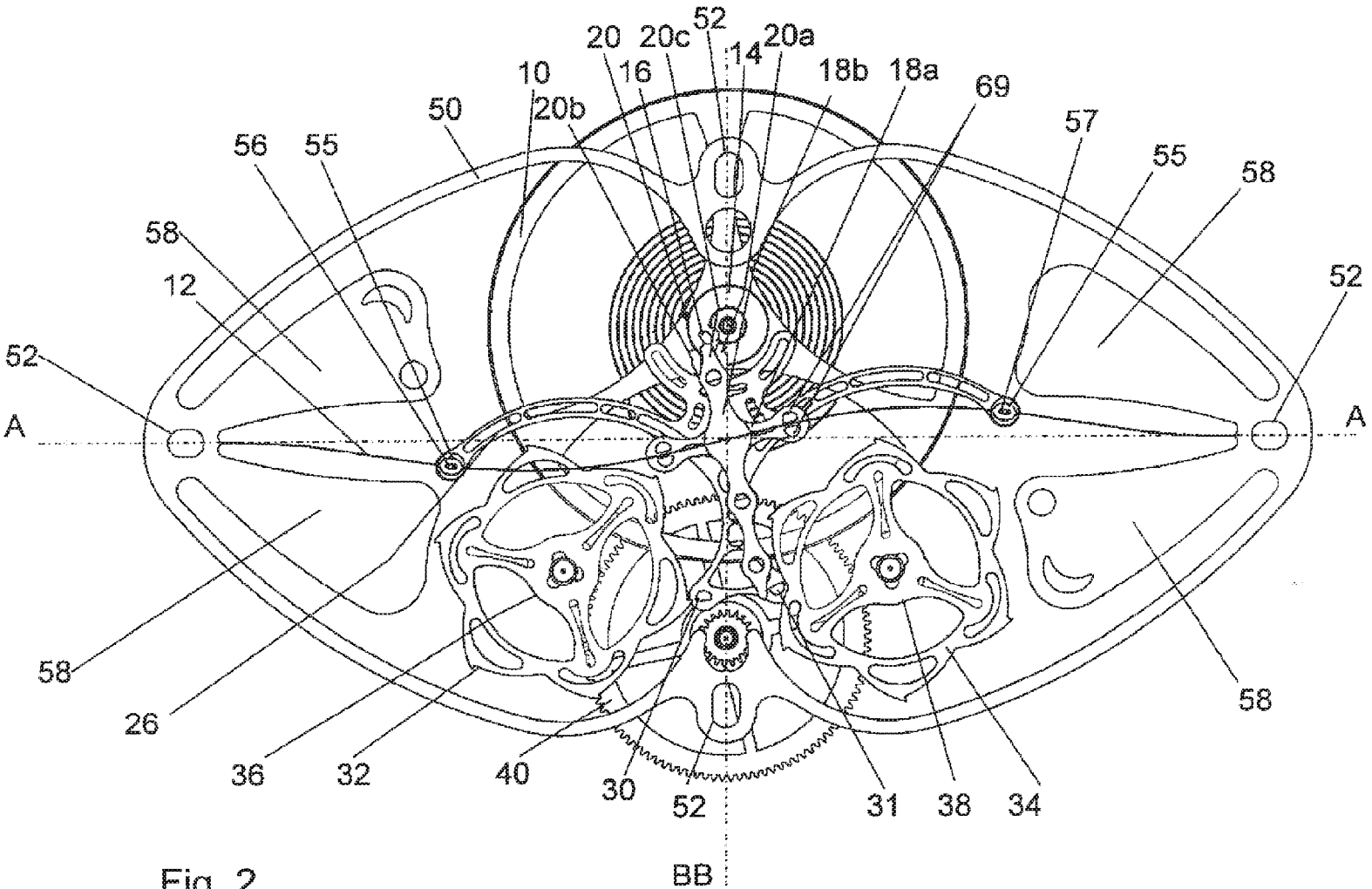
FIG. 2 is a top view of the essential parts of the escapement mechanism according to the invention.

FIG. 2 shows an escapement mechanism according to the invention. The components of the mechanism according to the invention that are also found in the mechanism described above in reference to FIG. 1 were designated by the same numbers. They will therefore not be described again in detail.

We will simply note that one finds, arranged on a frame of a clockwork movement, the following components:

- the balance 10 supporting the plate 14 and the impulse pin 16,
- the first detent yoke 18,
- the second winding yoke 26 with the two symmetrical wings and the central portion provided with third 30 and fourth 31 active elements, and
- the first 32 and second 34 escapement wheels.

According to a first aspect of the invention, the blade spring 12 is mounted on a deformable chassis 50. More particularly, the chassis is symmetrically deformable in relation to a first axis AA passing through the axes of rotation of the balance 10, yokes 18 and 26 and via the curvature point of the blade spring 12 and in relation to a second axis BB, perpendicular to the first and passing through the ends of the blade spring 12. In one preferred embodiment, the chassis 50 is elastically deformable. The deformation along the first AA and second BB axes is guaranteed via guide organs forcing the chasses 50 to deform along said axes. Said guide organs can be oblong housings 52 arranged in pairs and along the axes AA and BB in the chassis 50. They cooperate with pins 54 fixed on the frame of the movement. According to one particular feature, the chassis forms a frame that surrounds the axes of the components of the escapement mechanism.

In one advantageous embodiment, the blade spring 12 is made of monocrystalline silicon. Interesting elastic characteristics have, simply as an illustration, been obtained with a blade spring 12 measuring 0.02 mm in the direction of the first axis and about 0.1 mm thick. Silicon allows particularly precise machining, for extremely reduced dimensions.

To obtain effective cooperation between the second yoke 26 and the blade spring 12, despite its small dimensions, the latter includes two open slots 55, arranged symmetrically in relation to its curvature point, inside which fingers 56 and 57 are positioned, arranged protruding in relation to the yoke and replacing the keys-pins 28 and 29. The transmission of the energy, on one hand, and the precision of the positions of the yoke 26 and blade spring 12, on the other hand, are thus completely controlled.

So that the chassis 50 can be freely moved in reference to the oblong housings 52, it should undergo the least amount of gripping stress possible. It should, however, be positioned precisely in reference to the thickness of the movement, since it conditions the position of the blade spring 12, and should also be influenced as little as possible by outside shocks. Traditional fastening means are poorly suited to serve these purposes. It is proposed, according to one preferred embodiment, that the chassis be provided with maintenance surfaces 58. With a silicon frame 50, it is very easy to produce said surfaces directly, in a single piece with the chassis. These maintenance surfaces 58 are placed directly on the frame of the movement. For good efficiency, they are arranged symmetrically in relation to the two axes of symmetry of the chassis. In the example, there are four of these surfaces 58. Adjusting screws, not shown in the drawing, are housed in the frame of the movement such that the maintenance surfaces bear on the end thereof. Thus, these screws define the height of the chasses 50, which is positioned in reference to the thickness of the movement.

Maintenance organs, mounted on the frame of the movement, cooperate with the maintenance surfaces 58. To limit the stresses undergone by the chassis 50, these maintenance organs are elastically deformable in the direction of the thickness of the movement. They assume the form of arms 60, crossing the maintenance surfaces 58 remotely. The arms 60 have appendages 62, designed to be placed on the maintenance surfaces 58. The position of the arms 60 can be adjusted in reference to the thickness of the movement, so as to apply the maintenance surfaces on the screws, by adjusting the pressure applied on the maintenance surfaces 58. Preferably, the screws and the appendages 62 are positioned opposite each other, on either side of the maintenance surfaces 58.

Means for adjusting the position of the ends of the spring are provided. They are positioned on the frame of the movement, so as to act on the chassis 50, symmetrically to the axes AA and BB. According to the example, two levers 64 act on the outer edge of the chassis 50, and first and second points situated on the second axis of symmetry, on either side of the first. The levers 64 can be provided with runners 66 to act on the chassis 50. Once the position of the ends of the spring is adjusted, the levers 64 are kept in place, for example by an eccentric system 68 or by other means within the grasp of one skilled in the art. To this end, a type of self-centered gripper, of the catch-up gripper type, may be used. The position of the ends of the blade spring 12 could also be adjusted by separating the zones of the chassis 50 crossing the axis AA from each other.

Preferably, the chassis 50 is also made of silicon. The blade spring 12 and the chassis 50 can then be made in a single piece, arranged in a monocrystalline silicon plate. The DRIE (Deep Reactive Ion Etching) technique can be used. For example, the blade spring can be realized along crystallographic plane [110], plane [100] being the plane orthogonal to the wafer from which the chassis 50 comes. Other orientations can of course be chosen, one need only take into account the variations of Young's Modulus of Silicon as a function of the anisotropy of the Silicon, to dimension the chassis 50 and the blade spring 12.

The assembly formed by the chassis 50 and the blade spring 12 defines a sort of double-bow, symmetrical along axes AA and BB. At each intersection with one of these axes, the chassis has an oblong housing 52. The shape of the chassis 50 is defined so as to grant it the desired elasticity, allowing it to deform under the action of the levers 64. A person skilled in the art can, through appropriate tests, arrive without difficulty at a shape making it possible to obtain an elastically deformable silicon chassis.

According to another feature of the invention, the first yoke 18 is broken down, on one hand, into a first portion 18*a* including the horns 20*a* and 20*b* and, on the other hand, into a second portion 18*b*, superimposed on the first, including the dart 20*c*. The two portions are made integral, for example using lugs included in the first portion 18*a*, cooperating in the openings formed in the second 18*b*.

The second portion 18*b* is situated in the plane of the blade spring 12 and is integral therewith, which makes it possible to do away with the first and second active elements present in the mechanism of the prior art. Preferably, the second portion 18*b* is made of silicon and forms a single piece with the blade spring 12 and the chassis 50. It is provided with pivot means situated at the curvature point of the spring, allowing it to tilt to perform its functions. To improve the transmission of the torque between the blade spring 12 and the yoke 18, it is proposed in the example illustrated in the drawing, to arrange pins 69 on the first portion 18*a* and cooperating with the blade spring 12. Their role is different from that of the first and second active elements of the prior art, because they are not essential to the transmission of the torque between the blade spring 12 and the yoke 18, but only improve it. The same result could also be obtained by increasing the section of the blade spring 12 in the immediate vicinity of the yoke 18.

Figure 3:
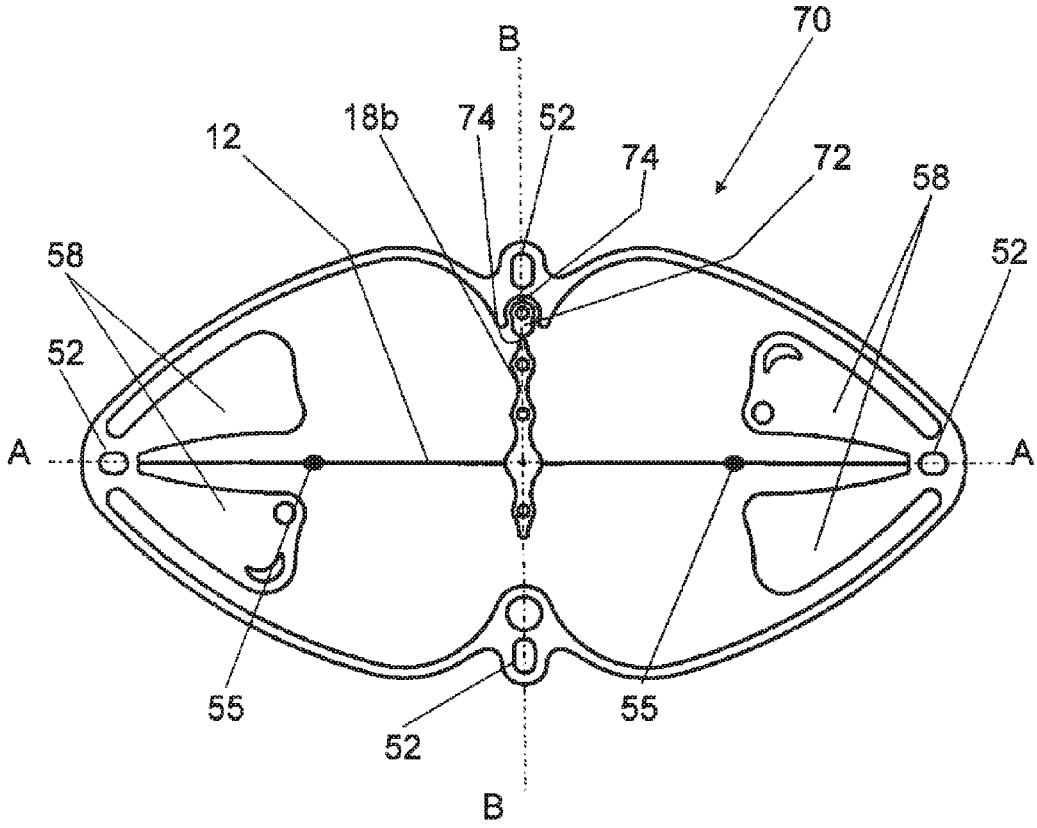
FIG. 3 is a particular view of a blade spring according to one advantageous embodiment of the invention.

To assemble the mechanism according to the invention, one acquires a single piece 70 shown in FIG. 3, made of silicon, comprising the chassis 50, the blade spring 12 and the second portion 18*b*. The features of the blade spring 12 do not make it possible to ensure good mechanical resistance of the second portion 18*b*, for its assembly. Originally, the single piece 70 is produced by arranging a stiffening portion 72 between the second portion 18*b* and the chassis 50, ensuring the mechanical resistance of the assembly. More precisely, the stiffening portion 72 is connected to the second portion 18*b* and to the chassis 50, via particularly thin first and second break zones 74, respectively, about 0.2 mm thick, that can be easily broken, as will be understood below.

Figure 4:
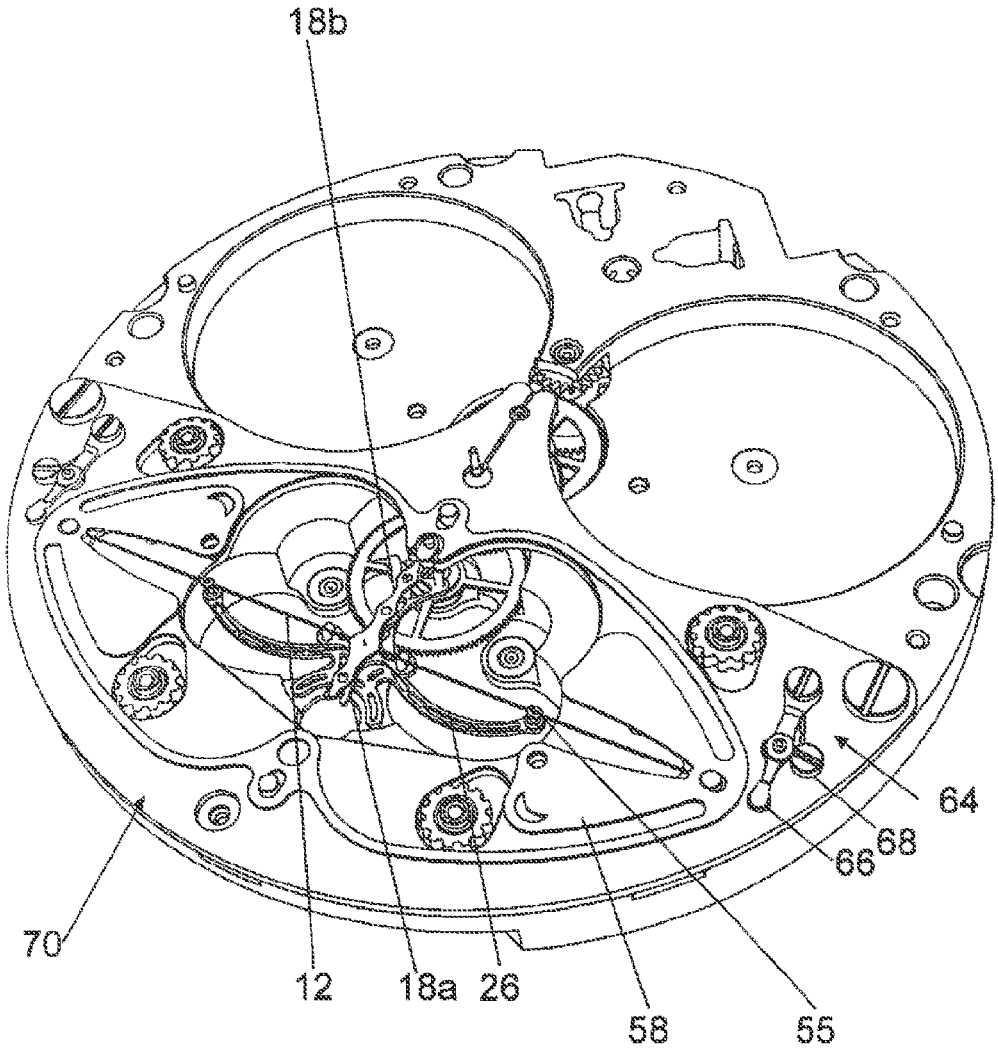
FIGS. 4 and 5 show successive views of the assembly of the mechanism.
Figure 5:
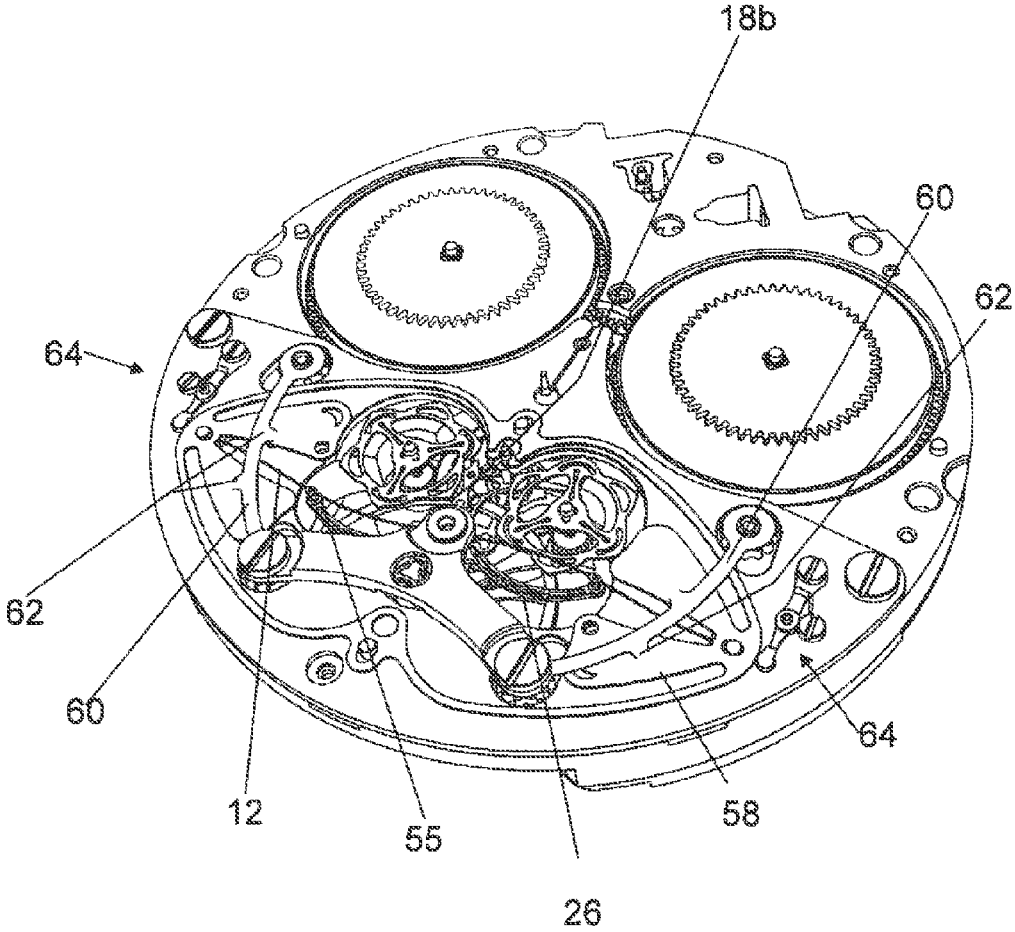

FIGS. 4 and 5 show different steps of the assembly of the mechanism according to the invention. In FIG. 4, a platform-escapement bottom plate is already in place, as well as the last wheel 40 of the going train. The levers 64 are also in position. The second yoke 26 and the first portion 18*a* of the first yoke 18 are assembled and the single piece 70 is arranged, housing the pins 54 in the corresponding oblong housings 52, and assembling the first 18*a* and second 18*b* portions of the first yoke 18. One will note the presence of the stiffening portion in FIG. 4. Then, the maintenance arms 60 are mounted before placing the escapement bridge (FIG. 5), which includes the complementary pivot means in particular for the first 18 and second 26 yokes. These two yokes 18 and 26 being, at this stage, pivoted above and below, the stiffening portion 72 can be broken at the break zones 74, and removed from the movement. The yokes can then oscillate. The tension of the blade spring 12 is then adjusted and it is buckled, such that its slots 55 cooperate with the fingers 56 and 57 of the second yoke. One will note that references and other indexes can be provided so as to apply a substantially equal force on both sides of the chassis. Owing to the guide organs, the chassis necessarily deforms symmetrically in relation to the two defined axes, guaranteeing that the blade spring is still correctly positioned.

Thus proposed is an escapement mechanism implementing a spring working in buckling, the tension of which can be adjusted particularly simply, while guaranteeing correct operation of the escapement. The description above was provided as a non-limiting illustration of the invention and a person skilled in the art may consider possible changes without, however, going beyond the scope of the invention.

The invention claimed is:

1. An escapement mechanism arranged to transmit mechanical energy pulses from a driving source to an oscillating regulator of a timepiece via a blade spring (12) operating in a buckling manner about a curvature point, said blade spring (12) being capable of accumulating the energy from the driving source between two pulses and transmitting it to said oscillating regulator upon each pulse via first (18) and second (26) yokes, characterized in that said blade spring (12) is mounted on a chassis (50) symmetrically deformable in relation to a first axis (AA) passing through the axes of rotation of the balance, yokes (18, 26) and via the curvature point and in relation to a second axis (BB), perpendicular to the first and passing through the ends of the blade spring (12).

2. The mechanism according to claim 1, characterized in that the chassis (50) is elastically deformable.

3. The mechanism according to claim 2, characterized in that the chassis (50) is a single piece, made of silicon.

4. The mechanism according to claim 3, characterized in that the chassis (50) and the blade spring (12) are a single piece, made of silicon.

5. The mechanism according to claim 4, characterized in that said blade spring (12) includes two slots (55) designed to cooperate with fingers (56, 57) of the second yoke (26).

6. The mechanism according to claim 1, characterized in that guide organs are arranged so as to force the frame (50) to deform along the first (AA) and second (BB) axes.

7. The mechanism according to claim 6, characterized in that said guide organs are protruding elements (54), designed to be integral with the frame of the clockwork movement, and oblong housings (52) arranged along the first and second axes, formed in the chassis that cooperate with said protruding elements.

8. The mechanism according to claim 1, also including first (32) and second (34) escapement wheels, characterized in that the chassis (50) forms a frame that surrounds the axes of the regulator, the first (32) and second (34) yokes and the first and second escapement wheels.

9. The mechanism according to claim 4, wherein the first yoke (18) is provided with a fork (20), provided with two horns (20*a*, 20*b*) and a dart (20*c*), designed to cooperate with a pin (16) and a plate (14) integral with the regulator organ, said first yoke ending with a tail, characterized in that said first yoke (18) is broken down into a first portion (18*a*), on one hand, and, on the other hand, a second portion (18*b*), superimposed on the first, said first and second portions being integral, and in that the second portion (18*b*) is situated in the plane of the blade spring (12) and is integral therewith.

10. The mechanism according to claim 9, characterized in that said second portion (18*b*) of the first yoke (18), the blade spring (12) and the chassis (50) are a single piece made of silicon.

11. The mechanism according to claim 1 mounted on a clockwork movement frame, characterized in that it includes maintenance organs, mounted adjustably on said frame, to position the chassis (50) in reference to the thickness of the mechanism.

12. The mechanism according to claim 11, characterized in that the chassis includes maintenance surfaces (58), and in that said maintenance organs are elastically deformable in the direction of the thickness of the mechanism and cooperate with the maintenance surfaces.

13. The mechanism according to claim 12, characterized in that said maintenance organs are arms (60), crossing the maintenance surfaces remotely and having appendages (62), designed to be placed on the maintenance surfaces (58).

14. The mechanism according to claim 5, wherein the first yoke (18) is provided with a fork (20), provided with two horns (20*a*, 20*b*) and a dart (20*c*), designed to cooperate with a pin (16) and a plate (14) integral with the regulator organ, said first yoke ending with a tail, characterized in that said first yoke (18) is broken down into a first portion (18*a*), on one hand, and, on the other hand, a second portion (18*b*), superimposed on the first, said first and second portions being integral, and in that the second portion (18*b*) is situated in the plane of the blade spring (12) and is integral therewith.

15. The mechanism according to claim 6, wherein the first yoke (18) is provided with a fork (20), provided with two horns (20*a*, 20*b*) and a dart (20*c*), designed to cooperate with a pin (16) and a plate (14) integral with the regulator organ, said first yoke ending with a tail, characterized in that said first yoke (18) is broken down into a first portion (18*a*), on one hand, and, on the other hand, a second portion (18*b*), superimposed on the first, said first and second portions being integral, and in that the second portion (18*b*) is situated in the plane of the blade spring (12) and is integral therewith.

16. The mechanism according to claim 7, wherein the first yoke (18) is provided with a fork (20), provided with two horns (20*a*, 20*b*) and a dart (20*c*), designed to cooperate with a pin (16) and a plate (14) integral with the regulator organ, said first yoke ending with a tail, characterized in that said first yoke (18) is broken down into a first portion (18*a*), on one hand, and, on the other hand, a second portion (18*b*), superimposed on the first, said first and second portions being integral, and in that the second portion (18*b*) is situated in the plane of the blade spring (12) and is integral therewith.

17. The mechanism according to claim 8, wherein the first yoke (18) is provided with a fork (20), provided with two horns (20*a*, 20*b*) and a dart (20*c*), designed to cooperate with a pin (16) and a plate (14) integral with the regulator organ, said first yoke ending with a tail, characterized in that said first yoke (18) is broken down into a first portion (18*a*), on one hand, and, on the other hand, a second portion (18*b*), superimposed on the first, said first and second portions being integral, and in that the second portion (18*b*) is situated in the plane of the blade spring (12) and is integral therewith.

18. A part (70) of an escapement mechanism arranged to transmit mechanical energy pulses from a driving source to an oscillating regulator of a timepiece via a blade spring (12) operating in a buckling manner about a curvature point, said blade spring (12) being capable of accumulating the energy from the driving source between two pulses and transmitting it to said oscillating regulator upon each pulse via first (18) and second (26) yokes, said blade spring (12) being mounted on a chassis (50) symmetrically deformable in relation to a first axis (AA) passing through the axes of rotation of the balance, yokes (18, 26) and via the curvature point and in relation to a second axis (BB), perpendicular to the first and passing through the ends of the blade spring (12), wherein the chassis is elastically deformable, wherein the first yoke (18) is provided with a fork (20), provided with two horns (20*a*, 20*b*) and a dart (20*c*), designed to cooperate with a pin (16) and a plate (14) integral with the regulator organ, said first yoke ending with a tail, said first yoke (18) being broken down into a first portion (18*a*), on one hand, and, on the other hand, a second portion (18*b*), superimposed on the first, said first and second portions being integral, and the second portion (18*b*) being situated in the plane of the blade spring (12) and being integral therewith, wherein said second portion (18*b*) of the first yoke (18), the blade spring (12) and the chassis (50) are a single piece made of silicon, wherein a stiffening portion (72) is arranged between said second portion (18*b*) and the chassis (50).

19. The part (70) according to claim 18, characterized in that said stiffening portion (72) is connected to said second portion (18*b*) and to the chassis (50), by first and second break zones (74), respectively.

* * * * *